US007183473B2

(12) United States Patent
Untermyer et al.

(10) Patent No.: US 7,183,473 B2
(45) Date of Patent: Feb. 27, 2007

(54) ERGONOMIC STRINGED INSTRUMENT AND ERGONOMIC ROUNDBACK GUITAR

(75) Inventors: Frank I. Untermyer, Weatogue, CT (US); Robert Darren Wallace, New Hartford, CT (US); David McDonald, Merrimack, NH (US); Scott Keeley, Longmeadow, MA (US); Julian Groeli, San Diego, CA (US)

(73) Assignee: Kaman Music Corporation, Bloomfield, CT (US)

( * ) Notice: Subject to any disclaimer, the term of this patent is extended or adjusted under 35 U.S.C. 154(b) by 178 days.

(21) Appl. No.: 10/909,542

(22) Filed: Aug. 2, 2004

(65) Prior Publication Data

US 2005/0022650 A1 Feb. 3, 2005

Related U.S. Application Data

(60) Provisional application No. 60/491,796, filed on Jul. 31, 2003.

(51) Int. Cl.
*G10D 3/00* (2006.01)

(52) U.S. Cl. ..... 84/267; 84/290; 84/291; D17/14

(58) Field of Classification Search ..... 84/267, 84/290, 291; D17/14
See application file for complete search history.

(56) References Cited

U.S. PATENT DOCUMENTS

| | | | | |
|---|---|---|---|---|
| 1,261,841 | A * | 4/1918 | Mortensen | 84/327 |
| 1,945,162 | A * | 1/1934 | Rasmussen | 84/327 |
| 3,251,258 | A | 5/1966 | Parker | |
| 3,426,638 | A | 2/1969 | Smith | |
| 3,474,697 | A * | 10/1969 | Kaman | 84/267 |
| D224,567 | S * | 8/1972 | Pelensky | D17/14 |
| 3,880,040 | A * | 4/1975 | Kaman | 84/291 |
| 3,979,993 | A * | 9/1976 | Proctor | 84/327 |
| 4,320,684 | A * | 3/1982 | Podunavac | 84/291 |
| D278,632 | S | 4/1985 | Erlewine | |
| 4,539,886 | A * | 9/1985 | Hoffart | 84/267 |
| D293,331 | S | 12/1987 | Erlewine et al. | |
| 5,078,037 | A | 1/1992 | Sutcliffe et al. | |
| 5,103,709 | A | 4/1992 | Foss, Jr. | |
| D351,181 | S | 10/1994 | Whiteside | |
| 5,388,492 | A * | 2/1995 | Olson | 84/327 |
| 5,396,823 | A * | 3/1995 | Hoshino | 84/291 |
| 5,549,026 | A * | 8/1996 | Gay, Jr. | 84/292 |
| 5,567,894 | A | 10/1996 | Shiomo | |

(Continued)

FOREIGN PATENT DOCUMENTS

| | | |
|---|---|---|
| DE | 20313487 | 11/2003 |

*Primary Examiner*—Gary F. Paumen
(74) *Attorney, Agent, or Firm*—Cantor Colburn LLP

(57) ABSTRACT

An ergonomic stringed instrument is described, presenting a novel ergonomic design incorporating one or more of an angled waist, provided as part of the waist portion of the stringed instrument bowl or body, and a contoured ridge, provided along at least a portion of the back of the stringed instrument bowl or body. The angled waist is provided on the treble side of the stringed instrument, which side may rest on the leg of a performer, and is configured with an angled contour towards the back of the stringed instrument. The contoured ridge runs along at least a portion of the bass side of the stringed instrument back and defines at least a slightly concave portion on the treble side of the contoured ridge.

30 Claims, 4 Drawing Sheets

U.S. PATENT DOCUMENTS

| | | | | | |
|---|---|---|---|---|---|
| 5,637,820 | A | | 6/1997 | Wittman | |
| 5,689,075 | A | * | 11/1997 | Rose | 84/297 R |
| 5,998,712 | A | * | 12/1999 | Schmidt | 84/291 |
| D418,859 | S | | 1/2000 | Herbold | |
| 6,034,308 | A | | 3/2000 | Little | |
| 6,441,283 | B1 | | 8/2002 | Scott | |
| 6,525,246 | B1 | | 2/2003 | Erismann | |
| 2002/0100357 | A1 | | 8/2002 | Williams | |

* cited by examiner

ERGONOMIC STRINGED INSTRUMENT AND ERGONOMIC ROUNDBACK GUITAR

CROSS REFERENCE TO RELATED APPLICATIONS

The present application claims priority to U.S. Provisional Patent Application No. 60/491,796, filed Jul. 31, 2003, the entire contents of which are specifically incorporated by reference herein.

BACKGROUND

Traditionally, guitar players or players of other stringed instruments may perform in any of a number of various positions, from seated, with the stringed instrument supported on the leg of the performer, to standing or walking, with the stringed instrument suspended from a strap. A wide range of pads and supports has been designed to facilitate placement of the stringed instrument in one or more of these positions.

For example, U.S. Pat. No. 3,979,993 to Proctor describes a support cushion for a plucked string instrument, wherein the cushion includes an oblique upper surface adapted to be placed between the underside of the instrument and the thigh of the performer such that the instrument is in an ideal position for classical playing.

U.S. Pat. Nos. 1,261,841, 1,945,162 and 5,388,492 describe guitar supports attachable and/or pendant to a guitar or other stringed instrument to facilitate placement or bracing of the instrument against the thigh or knee of a performer.

While various methods of supporting stringed instruments have been described by the prior art, there is room for improvement and further innovation.

SUMMARY

The presently described ergonomic stringed instrument presents a novel ergonomic design incorporating one or more of an angled waist, provided as part of the waist portion of the stringed instrument bowl or body, and a contoured ridge, provided along at least a portion of the back of the stringed instrument bowl or body.

The angled waist is provided on the treble side of the stringed instrument, which side may rest on the leg of a performer, and is configured with an angled contour towards the back of the stringed instrument.

The contoured ridge runs along at least a portion of the bass side of the stringed instrument back and defines at least a slightly concave portion on the treble side of the contoured ridge.

In another embodiment, a roundback guitar is provided with an angled waist that permits a performer to rest the guitar on either leg for an ergonomically correct playing position and reduces or prevents rotation of the roundback body around the leg during play.

In another embodiment, a roundback guitar is provided with a contoured ridge that reduces or prevents rocking of the roundback when the guitar is held in a standing position.

The above described and other features are exemplified by the following FIGURES and by the following Detailed Description.

BRIEF DESCRIPTION OF THE DRAWINGS

Referring now to the various FIGURES, wherein like elements are numbered alike.

PRIOR ART

PRIOR ART

DETAILED DESCRIPTION

Figure 1:
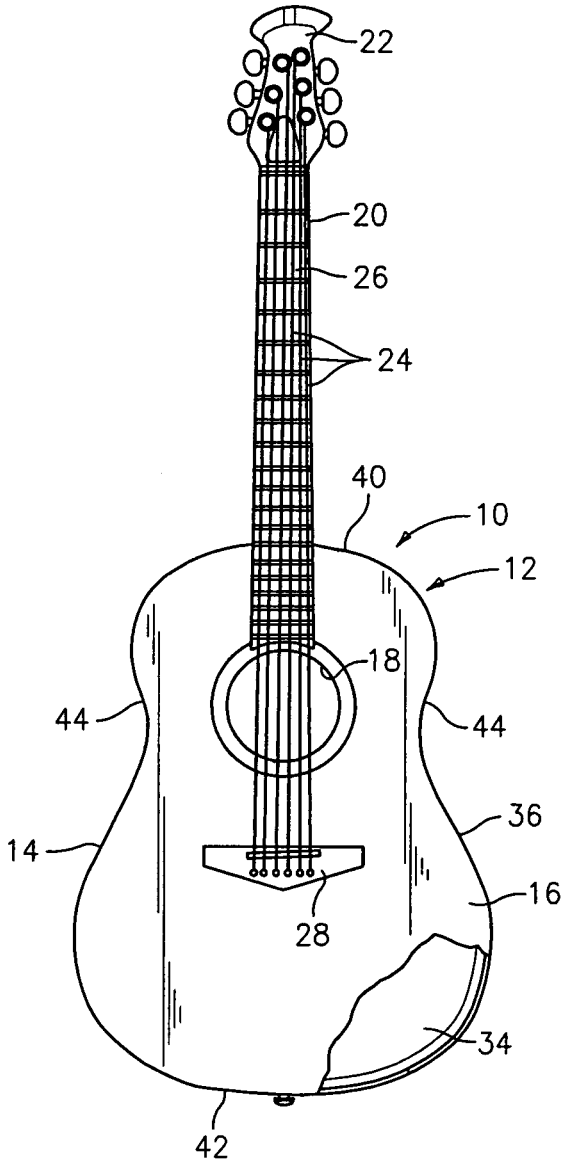
FIG. 1 (PRIOR ART)
FIG. 1 is a front elevation view of an exemplary acoustic guitar.
Figure 2:
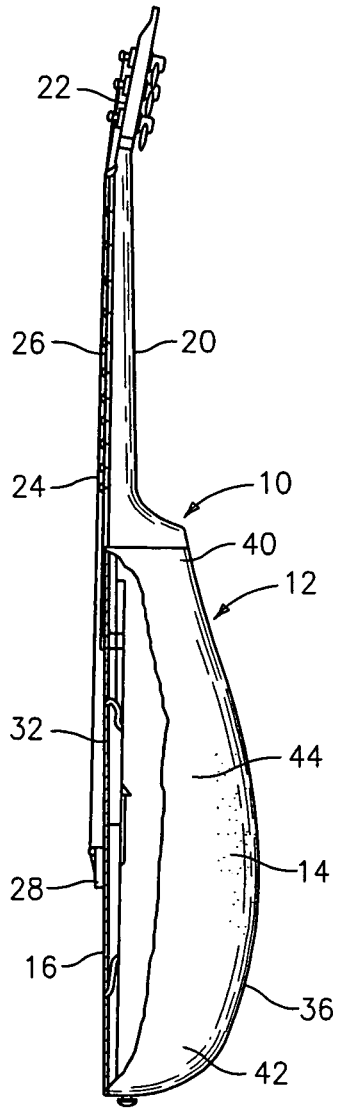
FIG. 2 (PRIOR ART)
FIG. 2 is a side elevation view of the exemplary acoustic guitar of FIG. 1.

Referring now to PRIOR ART FIGS. 1 and 2, drawn from our commonly assigned U.S. Pat. No. 3,474,697 to Kaman and incorporated herein by reference in its entirety, an exemplary stringed instrument is illustrated generally at 10. The instrument comprises an acoustic round back guitar comprising a hollow soundbox 12. The soundbox 12 includes a bowl shaped body 14 and a soundboard 16 having a sound opening 18. Extending upwardly from the soundbox 12 is an elongated neck 20 terminating in a peghead 22, provided with pegs for six strings 24 and carrying a fret board 26. The strings 24 extend between the peghead 22 and a bridge 28 secured to the soundboard 16.

Looking at the soundboard and neck illustrated by PRIOR ART FIG. 1, the leftmost string (or the "sixth string") comprises heavier gauge string relative to the rightmost string (or the "first string") and is traditionally tuned to lower notes relative to the rightmost string (e.g., the sixth string may be open tuned to "low E" while the first string may be open tuned to "high E"). Accordingly, the leftmost side of the illustrated guitar (the side closest to the sixth string or the lower tuned string) is the bass side of the guitar, while the rightmost side of the illustrated guitar (the side closest to the first string or the higher tuned string) is the treble side of the guitar.

Referring again to PRIOR ART FIGS. 1 and 2, the bowl-shaped body 14 includes a gently inwardly curving waist characteristic (narrowed portion) of a conventional guitar. The body terminates in a forward edge 32, and has an acoustically reflective inner surface 34 at least a portion of which is generally parabolic. The body includes a two-dimensionally curved or arched rear portion 36, and has an integral side portion 38 including generally U-shaped upper and lower bouts (wider portions relative to the waist), relatively indicated at 40 and 42, connected by inwardly curved central bouts 44, which form the waist of the instrument. The side portion 38 adjacent its forward edge 32 is substantially perpendicular to the soundboard 16. In planes perpendicular to the soundboard, it extends in an approximate straight line rearwardly from the soundboard for a substantial distance and then curves inwardly to smoothly blend with the arched rear portion 36. The side portion 38 therefore spaces the back portion 36 from the soundboard and the back portion has a relatively broad or gentle curvature, and thereby a generally conventional front to rear thickness of the soundbox is maintained while allowing the rear wall to provide a broadly curved acoustically reflective surface.

Figure 4:
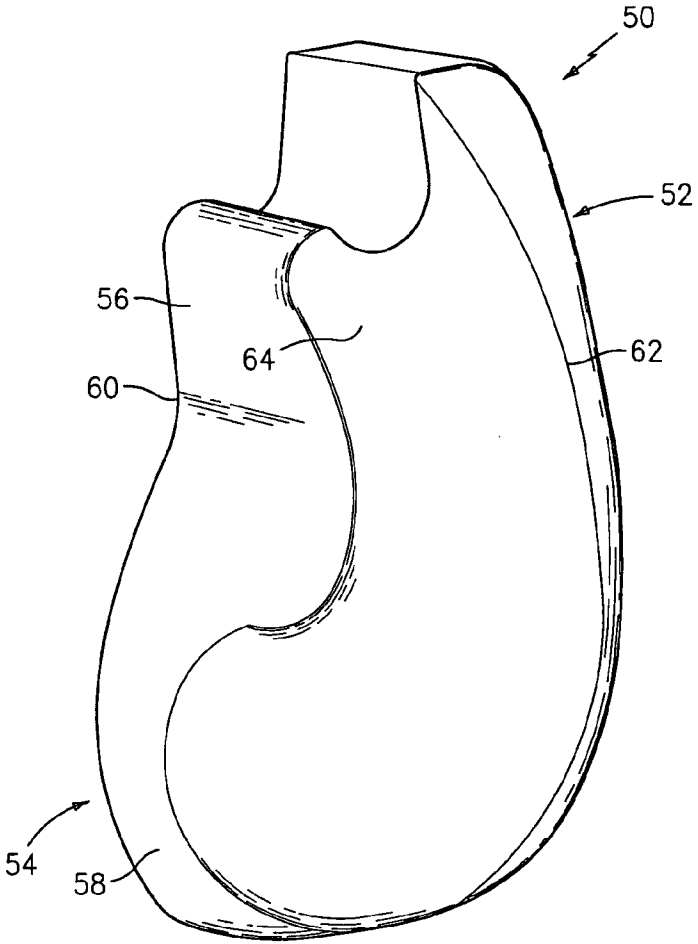
FIG. 4 is a perspective view of the exemplary guitar bowl of FIG. 3.
Figure 3:
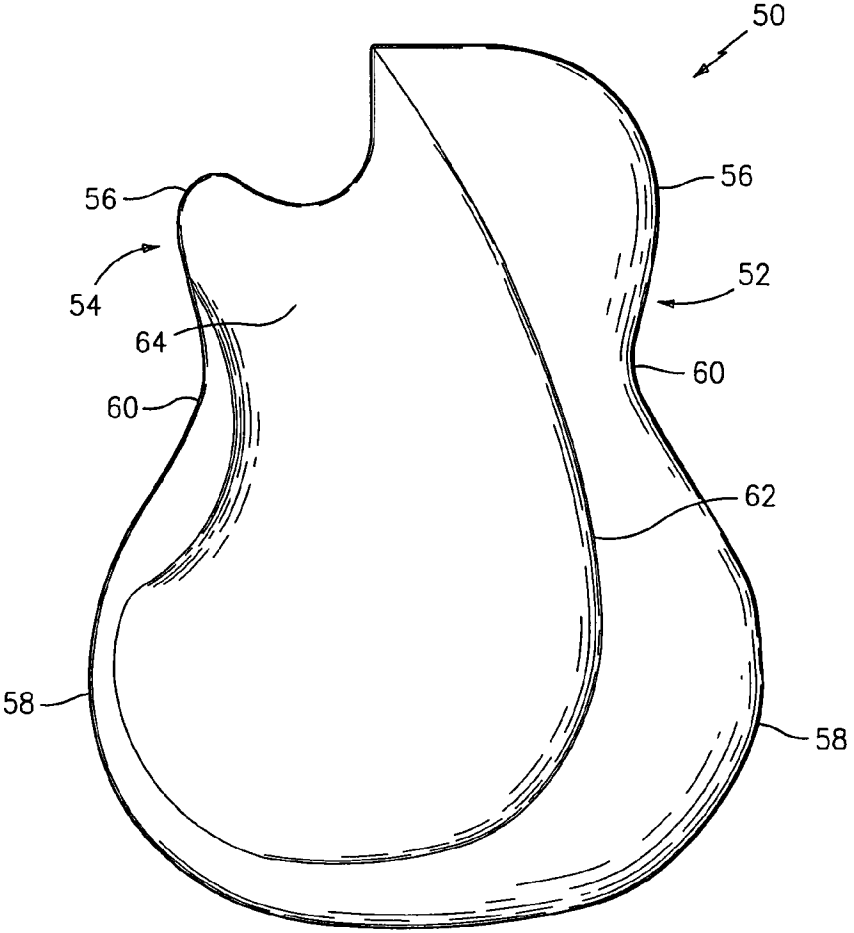
FIG. 3 is a top elevation view of an exemplary guitar bowl incorporating both a curved, angled waist and a contoured ridge.
Figure 5:
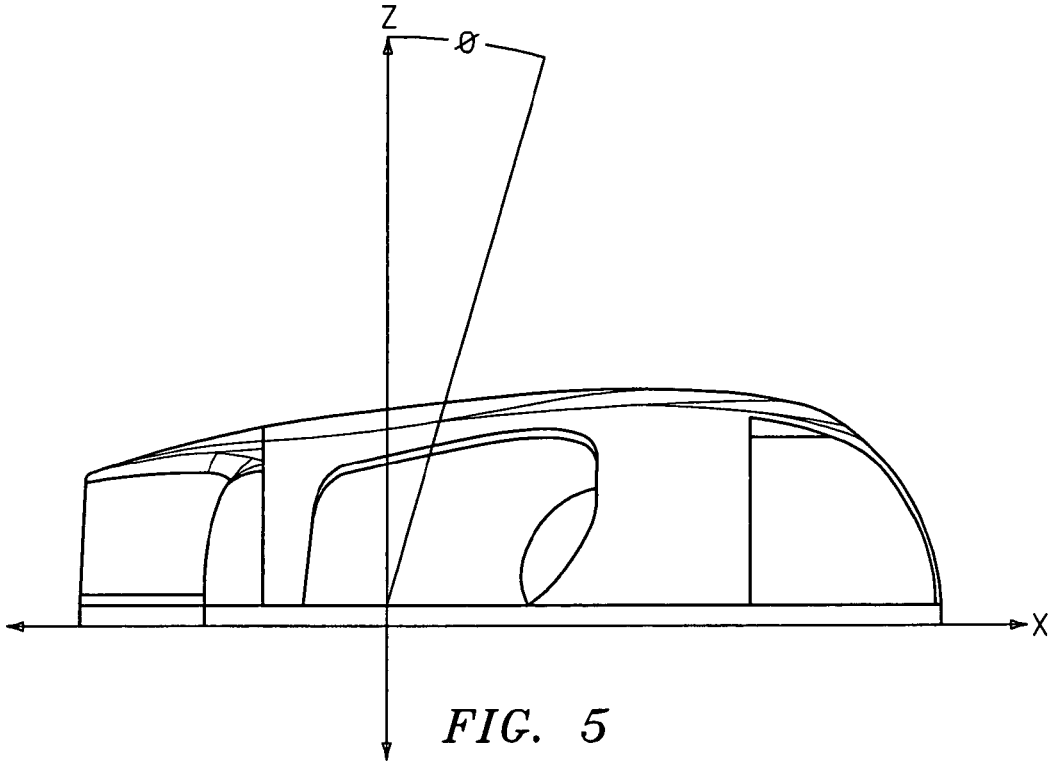
FIG. 5 is a side plan view of the exemplary guitar bowl of FIG. 3 as seen through the x-z plane.
Figure 7:
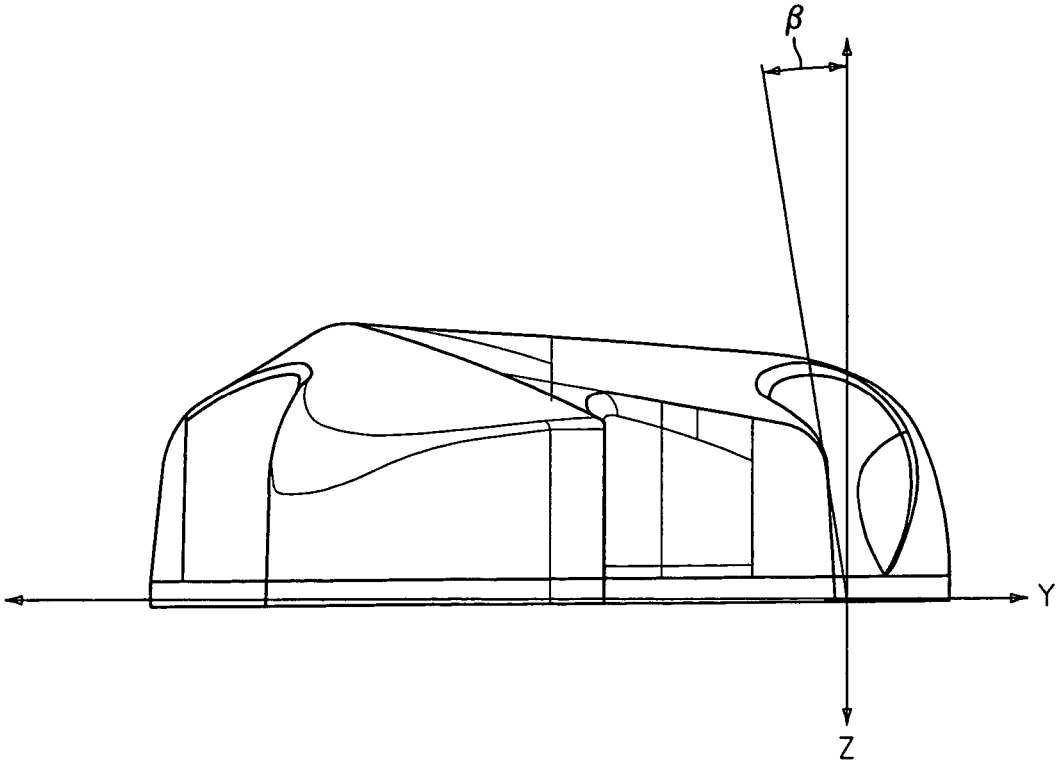
FIG. 7 is a front plan view of the exemplary guitar bowl of FIG. 3 as seen through the y-z plane.
Figure 6:
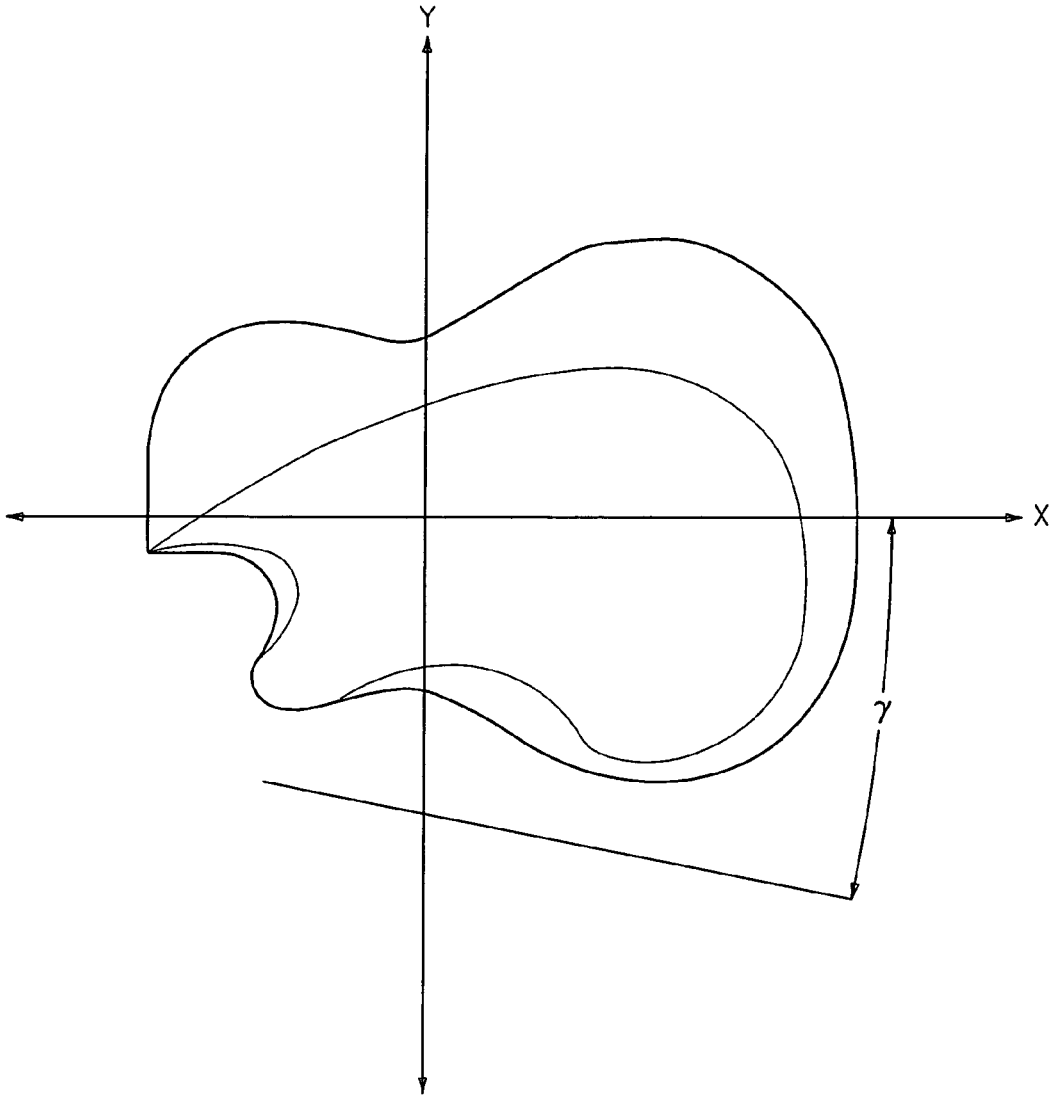
FIG. 6 is a top plan view of the exemplary guitar bowl of FIG. 3 as seen through the x-y plane.

Referring now to FIGS. 3 and 4, an exemplary guitar body 50 in accordance with the present invention is illustrated in a top elevation view and in a perspective view, respectively. The illustrated exemplary guitar body 50 generally includes a bass side 52 and a treble side 54. The illustrated guitar body 50 also generally includes upper and lower bouts, 56, 58 and inwardly curved bouts 60, which form a curved waist. Additionally, at least a portion of the curved waist of the illustrated exemplary body includes, on the treble side 54, an angled orientation directed generally towards the back of the guitar body 50. The angled orientation towards the back of the guitar body, along with the curved nature of the waist, provides a complex curve that advantageously facilitates ergonomic support of the guitar on the leg or knee of the performer. Indeed, the presently described waist permits secure support and positioning of the guitar on either leg of the performer for an ergonomically correct playing position. Not only does such positioning enhance the comfort and playability of the guitar, but it also prevents rotation and facilitates bringing of the neck of the guitar into a more proper and consistent playing position The angled orientation of the at least one portion of the novel waist presently described may best be described with reference to FIGS. 5–7, which illustrate plan views of the exemplary guitar body in Cartesian space. FIG. 5 illustrates a side plan view of the treble side of the exemplary guitar body as it may be viewed through the x-z plane. FIG. 6 illustrates a top plan view of the exemplary guitar body as it may be viewed through the x-y plane. FIG. 7 illustrates a front plan view of the exemplary guitar body as it may be viewed through the y-z plane. The exemplary guitar illustrated in FIGS. 5–7 is provided with a soundboard surface within the x-y plane.

With specific reference to the illustrated exemplary embodiment of FIG. 5, a portion of the waist is oriented an angle theta ($\theta$) within the x-z plane and relative to the z-axis. In the illustrated embodiment, theta measures 15.19 degrees. With specific reference to the illustrated exemplary embodiment of FIG. 6, a corresponding portion of the waist may be oriented an angle gamma ($\gamma$) within the x-y plane and relative to the x-axis. In the illustrated embodiment, gamma measures 11.12 degrees. With reference to the illustrated exemplary embodiment of FIG. 7, a corresponding portion of the waist may be oriented an angle beta ($\beta$) within the y-z plane and relative to the z-axis. In the illustrated embodiment, beta measures approximately 8 degrees. The integration of theta, gamma and beta provides an indication of the angular orientation of a discrete portion of the present novel curved, angled waist. While specific angles have been described, it is to be recognized that these are merely exemplary angles describing the three dimensional orientation of a single portion of the novel curved, angled waist described herein.

It should also be recognized that the three dimensional orientation of portions of the novel curved, angled waist may comprise any angle(s) as long as at least some portion of the curved, angled waist is directed towards the back of the guitar and not substantially perpendicular to the soundbox (i.e., at least one of theta and beta should not equal zero (0) degrees). Additionally and as long as at least one portion of the waist is oriented towards the guitar back, the line intersecting the z- or x-axis that is provided at either of angles theta and beta may have a positive or a negative slope. In one exemplary embodiment and in at least one portion of the present waist, one or both of theta and beta are not substantially perpendicular and are up to 85 degrees, with the slope of the line intersecting the z- or x-axis in the y-z plane or the x-z plane, respectively, being positive for theta and negative for beta. In another exemplary embodiment and in at least one portion of the present waist, one or both of theta and beta are between 2 degrees and 65 degrees. In another exemplary embodiment and in at least one portion of the present waist, one or both of theta and beta are between 5 and 45 degrees. In another exemplary embodiment, beta is zero and theta is between 65 and 85 degrees, and the line intersecting the x-axis in the x-z plane has a positive slope.

With reference to FIG. 6, gamma may be any angle that orients a portion of the present waist towards a further portion of the guitar back, whether that portion is on the treble side or on the bass side of the guitar. Accordingly, the line intersecting the x-axis that is provided at an angle gamma from the x-axis may have a positive or a negative slope. In one embodiment, gamma is greater than zero and up to 85 degrees and the line intersecting the x-axis has a negative slope. In another embodiment, gamma is between zero and 60 degrees. In another embodiment, gamma is between zero and 40 degrees. In another embodiment, gamma is between zero and 20 degrees. In another embodiment, gamma is between zero and 15 degrees, and the line intersecting the x-axis has a positive slope.

In another exemplary embodiment, treble side of the curved waist includes different portions with differing thetas and/or betas and/or gammas, e.g., such that there is a concave or convex surface between such different portions.

Referring again to FIGS. 3 and 4, the illustrated exemplary embodiment also includes a contoured ridge 62 provided on at least a portion of the bass side 52 of the guitar body 50. Such exemplary contoured ridge 62 is illustrated as scribing a curve along the bass side 52 of the body. The illustrated ridge 62 originates above the upper bouts 56 and extends below the lower bouts 58. The treble side 54 of the contoured ridge 62 importantly includes at least a slightly concave portion 64. Such portion 64 and such ridge 62 are generally configured to rest against the body of a performer when the guitar is positioned in either of a seated or a standing position. This concave portion 64, in conjunction with the ridge 62, advantageously stabilizes the guitar and reduces rocking of the guitar in either the seated or the standing positions.

It is noted that while the exemplary embodiment illustrating the contoured ridge describes a ridge 62 extending at least between upper and lower bouts 56, 58, the present disclosure contemplates a contoured ridge that may extend only along a portion of the bass side 56 of the guitar body. Accordingly, the concave portion 64 may, in such cases, extend only along a portion of the treble side of the contoured ridge.

It is also noted that the presently described curved, angled waist and the presently described contoured ridge have been illustrated by a particular exemplary embodiment, i.e., a guitar, acoustic and roundback. Indeed, the described curved, angled waist and the contoured ridge illustrated by the above exemplary embodiments find good and advantageious application with regard to the roundback design. The angled waist not only permits a performer to rest the instrument on either leg for an ergonomically correct playing position, but it also reduces or prevents rotation of the instrument body around the leg of the performer during play.

The contoured ridge provided with the roundback design (among other designs) reduces or prevents rocking of the roundback when the guitar is held in a standing position. This advantage provides the performer not only with a more comfortable playing position, but also reduces or eliminates the performer's need to use an arm to stabilize the guitar during play.

The present disclosure contemplates any number of alternate embodiments, from differing acoustic or acoustic-electric bowl and body designs to electric guitar body designs or to different types of stringed instruments, in general.

Accordingly, the present invention has been described by way of example and not limitation.

What is claimed is:

1. An ergonomic body for a stringed instrument, comprising:

a stringed instrument body portion having a top portion configured to communicate with a stringed instrument neck portion provided with a plurality of strings of varying pitch, a bottom portion opposite said top portion, a treble portion provided on a side of the instrument body nearer the strings having higher pitch, and a bass portion provided on a side of the instrument body nearer the strings having lower pitch; and a waist portion, comprising a narrowing of the instrument body on said treble portion relative to a longitudinal axis between said top portion and said bottom portion, the waist portion further provided with an angled contour on said treble portion and between said top portion and said bottom portion, wherein said angled contour, in at least one portion of the waist portion, extends away from the periphery of the waist portion and towards the back of the stringed instrument.

2. The ergonomic body of claim 1, wherein said longitudinal axis comprises an x-axis, and wherein an axis between the treble and bass sides of the instrument body comprises a y-axis, and wherein an axis between the front portion and the back portion of the instrument body comprises a z-axis, and wherein said at least one portion of the waist portion extends from the z-axis towards the x-axis at an angle theta, and wherein said at least one portion of the waist portion extends from the z-axis towards the y-axis at an angle beta, further wherein at least one of theta and beta is greater than zero.

3. The ergonomic body of claim 2, wherein at least one of theta and beta is between zero and 85 degrees.

4. The ergonomic body of claim 2, wherein at least one of theta and beta is between two and 65 degrees.

5. The ergonomic body of claim 2, wherein at least one of theta and beta is between five and 45 degrees.

6. The ergonomic body of claim 2, wherein at least one of theta and beta is between 10 and 30 degrees.

7. The ergonomic body of claim 2, wherein at least a second portion of said waist has an angled contour different from that of said at least one portion of said waist.

8. The ergonomic body of claim 7, wherein said at least second portion of said waist has a different beta value than said at least one portion of said waist.

9. The ergonomic body of claim 8, wherein said at least second portion of said waist has a different theta value than said at least one portion of said waist.

10. The ergonomic body of claim 8, wherein said at least second portion and said at least one portion define at least two points on a concave surface.

11. The ergonomic body of claim 1, wherein said body is a guitar body.

12. The ergonomic body of claim 11, wherein said guitar body is an acoustic guitar body.

13. An ergonomic body for a stringed instrument, comprising:

a stringed instrument body portion having a top portion configured to communicate with a stringed instrument neck portion provided with a plurality of strings of varying pitch, a bottom portion opposite said top portion, a treble portion provided on a side of the instrument body nearer the strings having higher pitch, and a bass portion provided on a side of the instrument body nearer the strings having lower pitch; and a contoured ridge provided on at least a portion of said bass portion, wherein at least a portion of said contoured ridge defines an edge of a concave portion, which concave portion is provided at least partially on the treble side of said contoured ridge.

14. The ergonomic body of claim 13, wherein said contoured ridge scribes a curve along at least a portion of said bass portion.

15. The ergonomic body of claim 13, wherein said contoured ridge originates in said top portion and terminated in said bottom portion.

16. The ergonomic body of claim 13, wherein said body is a guitar body.

17. The ergonomic body of claim 16, wherein said guitar body is an acoustic guitar body.

18. An ergonomic roundback bowl for a roundback guitar, comprising:

a roundback guitar bowl having a top portion configured to communicate with a stringed instrument neck portion provided with a plurality of strings of varying pitch, a bottom portion opposite said top portion, a treble portion provided on a side of the roundback bowl nearer the strings having higher pitch, and a bass portion provided on a side of the roundback bowl nearer the strings having lower pitch;

a waist portion, comprising a narrowing of the roundback bowl on said treble portion relative to a longitudinal axis between said top portion and said bottom portion, the waist portion further provided with an angled contour on said treble portion and between said top portion and said bottom portion, wherein said angled contour, in at least one portion of the waist portion, extends away from the periphery of the waist portion and towards the back of the roundback guitar.

19. The roundback bowl of claim 18, wherein said longitudinal axis comprises an x-axis, and wherein an axis between the treble and bass sides of the roundback bowl comprises a y-axis, and wherein an axis between the front portion and the rounded back portion of the roundback bowl comprises a z-axis, and wherein said at least one portion of the waist portion extends from the z-axis towards the x-axis at an angle theta, and wherein said at least one portion of the waist portion extends from the z-axis towards the y-axis at an angle beta, further wherein at least one of theta and beta is greater than zero.

20. The roundback bowl of claim 19, wherein at least one of theta and beta is between zero and 85 degrees.

21. The roundback bowl of claim 19, wherein at least one of theta and beta is between two and 65 degrees.

22. The roundback bowl of claim 19, wherein at least one of theta and beta is between five and 45 degrees.

23. The roundback bowl of claim 19, wherein at least one of theta and beta is between 10 and 30 degrees.

24. The roundback bowl of claim 19, wherein at least a second portion of said waist has an angled contour different from that of said at least one portion of said waist.

25. The roundback bowl of claim 24, wherein said at least second portion of said waist has a different beta value than said at least one portion of said waist.

26. The roundback bowl of claim 25, wherein said at least second portion of said waist has a different theta value than said at least one portion of said waist.

27. The roundback bowl of claim 25, wherein said at least second portion and said at least one portion define at least two points on a concave surface.

28. An roundback bowl for a roundback guitar, comprising:

a roundback guitar bowl having a top portion configured to communicate with a guitar neck portion provided with a plurality of strings of varying pitch, a bottom portion opposite said top portion, a treble portion provided on a side of the roundback bowl nearer the strings having higher pitch, and a bass portion provided on a side of the roundback bowl nearer the strings having lower pitch; and a contoured ridge provided on at least a portion of said bass portion, wherein at least a portion of said contoured ridge defines an edge of a concave portion, which concave portion is provided at least partially on the treble side of said contoured ridge.

29. The roundback bowl of claim 28, wherein said contoured ridge scribes a curve along at least a portion of said bass portion.

30. The roundback bowl of claim 28, wherein said contoured ridge originates in said top portion and terminated in said bottom portion.

* * * * *